US005225066A

United States Patent [19]

Drew

[11] Patent Number: 5,225,066

[45] Date of Patent: Jul. 6, 1993

[54] GALVANICALLY ENHANCED CRIMPED CONNECTION

[75] Inventor: George A. Drew, Warren, Ohio

[73] Assignee: General Motors Corporation, Detroit, Mich.

[21] Appl. No.: 854,709

[22] Filed: May 11, 1992

[51] Int. Cl.[5] ..... C25D 5/02; C23C 18/54

[52] U.S. Cl. ..... 205/85; 205/114; 205/205; 205/222

[58] Field of Search ..... 205/85, 114, 205, 222

[56] References Cited

U.S. PATENT DOCUMENTS 3,372,476 3/1968 Peiffer et al. ..... 29/628
3,622,944 11/1971 Tsuchiya et al. ..... 339/118 R
3,686,746 8/1972 Gwyn, Jr. ..... 29/488
4,470,883 9/1984 Eichelberger et al. ..... 205/85
4,622,109 11/1986 Puppolo ..... 205/85

*Primary Examiner*—John Niebling
*Assistant Examiner*—William T. Leader
*Attorney, Agent, or Firm*—Lawrence B. Plant

[57] ABSTRACT

A wire having a terminal crimped to one end thereof and an electrodeposited metal emanating from either the terminal or the wire electrically bridging the wire and the terminal. A process for making the aforesaid wherein the terminal and the wire comprise dissimilar metals having different oxidation potentials in the presence of an electrolyte and wherein the joint between the terminal and the wire is contacted with an electrolyte to deplate the more anodic metal and deposit it on the more cathodic metal.

6 Claims, 2 Drawing Sheets

GALVANICALLY ENHANCED CRIMPED CONNECTION

This invention relates to electrical wires having terminals mechanically crimped to the ends thereof, and more particularly, low resistance connections between such terminals and wires.

BACKGROUND OF THE INVENTION

It is well known to mechanically crimp terminals onto the end of electrical wires. Crimping provides a permanent electrical and mechanical connection between the wire and the terminal. Such connections are common in single and multi-strand wires. The terminals typically include a nest portion that receives the wire and at least one wing portion which overlies the wire and is crimped thereto along with the body of the terminal defining the nest portion so as to securely hold the wire therebetween.

One of the problems with crimped connections is that, following the crimping step, the wing(s) will frequently spring back somewhat resulting in a somewhat looser grip on the wire than occurs while the wire/terminal are in the jaws of the crimper. Such spring back often leaves small air gaps between the terminal and the wire. The electrical resistance between crimped terminals and their associated wire typically increases with time as the wires and terminals oxidize and contaminants accumulate in the air gaps that are formed between the wire and the terminal. This problem is more acute in multi-strand wires where the crimping operation also tends to separate some of the strands forming small gaps therebetween and providing a higher surface area exposed to such oxidation/contamination then would otherwise occur if the bundle of wires had not been squeezed in the crimper.

One way to eliminate the aforesaid problem and provide a permanent low-resistance connection is to solder the terminal to the wire. The solder forms a stable metallurgical bond to both the terminal and the wire which precludes subsequent oxidation/contamination from occurring in the gaps and forms a conductive metallic bridge between the wires and terminals which provides a long term, low-resistance connection. Unfortunately, crimped and soldered connections are expensive to manufacture, and often difficult to control, processwise. It would be desirable if an inexpensive technique could be developed to provide a conductive metal bridge between a wire and a terminal crimped thereon which, in turn, produces a long term, low-resistance connection.

It is an object of the present invention to provide an unique low-resistance, crimped-on, wire-terminal connection having a low resistance, metallic bridge between the terminal and the wire, and a simple, inexpensive technique for making such a connection.

This and other objects and advantages of the present invention will become more readily apparent from the detailed description thereof which follows.

BRIEF DESCRIPTION OF THE INVENTION

The present invention contemplates a terminated wire having an electrical terminal mechanically crimped onto the end thereof, wherein: (1) the wire and terminal or terminal surface finish comprise dissimilar metals having differing oxidation and reduction potentials in the presence of an electrolyte; and (2) an electrodeposit of the more anodic of the dissimilar metals formed on the more cathodic of the metals and electrically bridging any air gaps between the wire(s) and the terminal. The invention further contemplates a simple process for forming such a bridge in a crimped connection between a wire and terminal including the steps of: (1) crimping a terminal comprising one metal onto a wire(s) comprising a different metal wherein the respective metals have different oxidation and reduction potentials in the presence of an electrolyte such that one metal is more anodic than the other; and (2) contacting the joint formed between the wire and the terminal with sufficient electrolyte to electrodeposit some of the more anodic metal onto the less anodic (i.e., more cathodic) metal and form a metallic bridge of electrodeposit between the wire and terminal. In a preferred embodiment: (1) the wire is multi-strand wire having a plurality of individual wires bundled together; (2) the more anodic metal is coated onto the terminal; and (3) electrolyte is applied (e.g., by dipping, spraying or otherwise) to the wire before the terminal is crimped thereon. In a most preferred embodiment, the wire comprises copper and the terminal comprises tin-coated bronze. By the term copper is meant essentially pure copper as well as such alloys of copper as are commonly used for electrical conductors. Obviously other metals may be used in the alternative of the wire and/or the terminal. When the terminal is crimped to the electrolyte wetted wire an external circuit is made which begins the galvanic process and causes the more anodic metal (e.g., tin) to deplate from the terminal, plate out on the wire, and bridge the gap therebetween. Once begun, the process is self-executing and continues for so long as there is electrolyte present or until the more anodic metal so covers the cathodic metal as to cut-off further reaction.

DETAILED DESCRIPTION OF THE INVENTION

Figure 1:
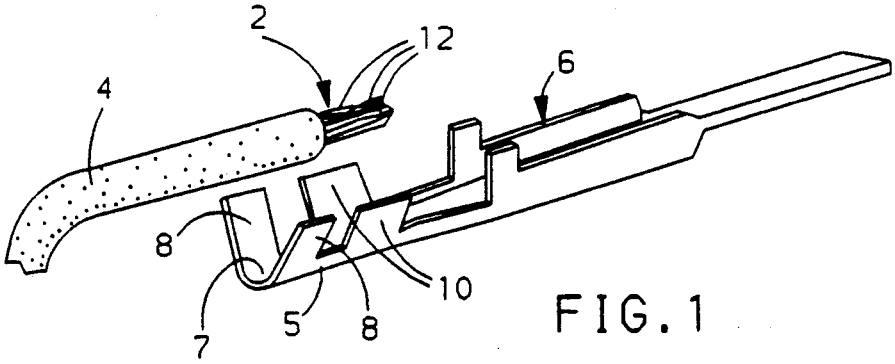
FIG. 1 illustrates a wire and terminal therefor prior to assembly.
Figure 2:
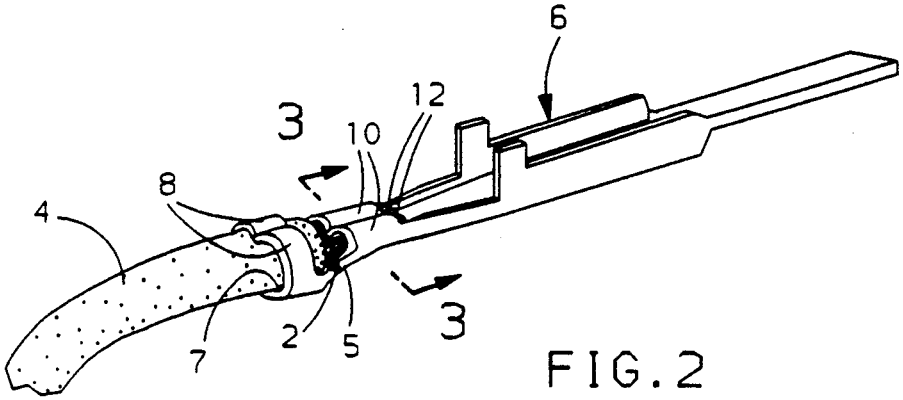
FIG. 2 illustrates the wire and terminal of FIG. 1 after crimping.

The Figures depict a multi-strand wire 2 having individual wire strands 12, an insulating coating 4 thereover, and a terminal member 6 for attachment thereto. The terminal member 6 has a concave body portion 5 so curved as to form a nest 7 for receiving the wire 2, and a plurality of wings 8 and 10 for engaging the insulated wire 2. More specifically and as best shown in FIG. 2, the wings 8 are crimped onto the insulator portion 4 while the wings 10 are crimped onto the conductive wire 2.

Figure 3:
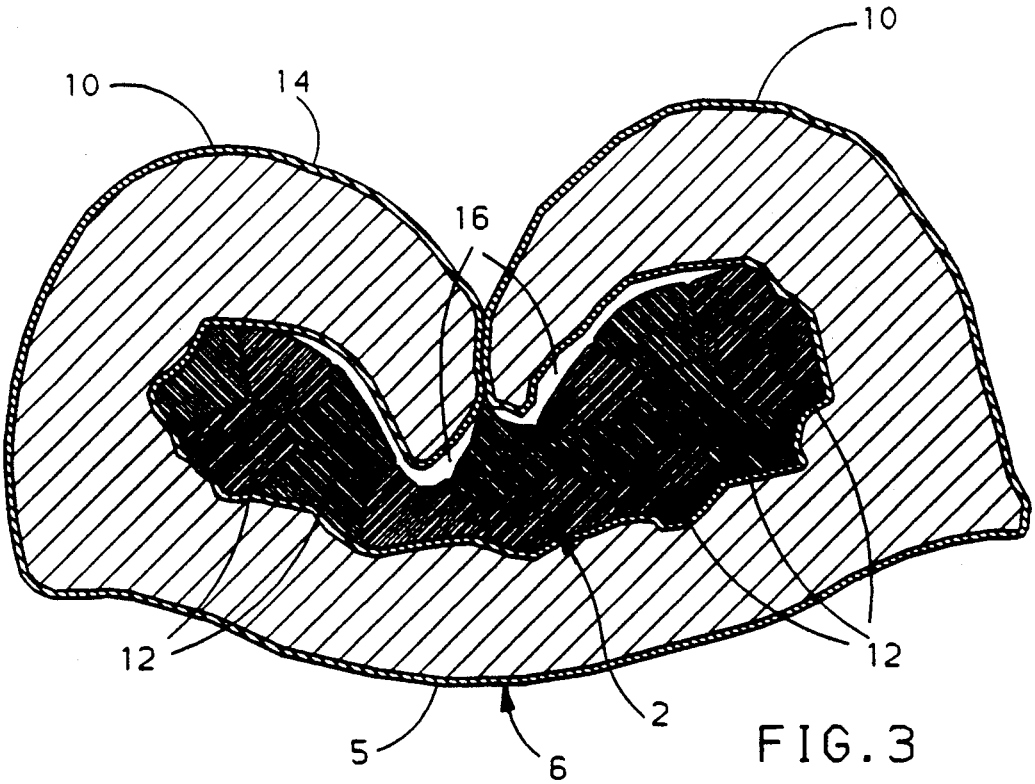
FIG. 3 illustrates the terminal of FIG. 2 taken in the direction 3—3 of FIG. 2 shortly after crimping occurs.

The terminal 10 preferably comprises a highly conductive material such as bronze which is coated (i.e., about 100–300 microinches thick) with a metal 14 which has a higher anodic potential than the metal forming the wires 12. While tin is the preferred such anodic metal because of its durability, corrosion resistance, low cost, ease of coating and relatively high anodic potential relative to copper, virtually any metal more anodic than copper can be used and chosen by reference to any well known table of Standard Oxidation Electrode Potentials such as is published in F. Daniels, *Outlines of Physical Chemistry*, John Wiley & Sons, Inc., New York (1948), P.447. During crimping, the wings 10 bite into the wire 2. However as best illustrated in FIG. 3, after the crimping force is removed, the wings 10 spring back to leave air gaps 16 between the wings 10 and the wires 2 as well as smaller gaps between the wire strands themselves (not shown) at the surface of the bundle. These air gaps 16 are sites where oxidation occurs or other contamination accumulates and interferes with electrical conduction between the wire and the terminal and to some extent between the wires themselves.

Figure 4:
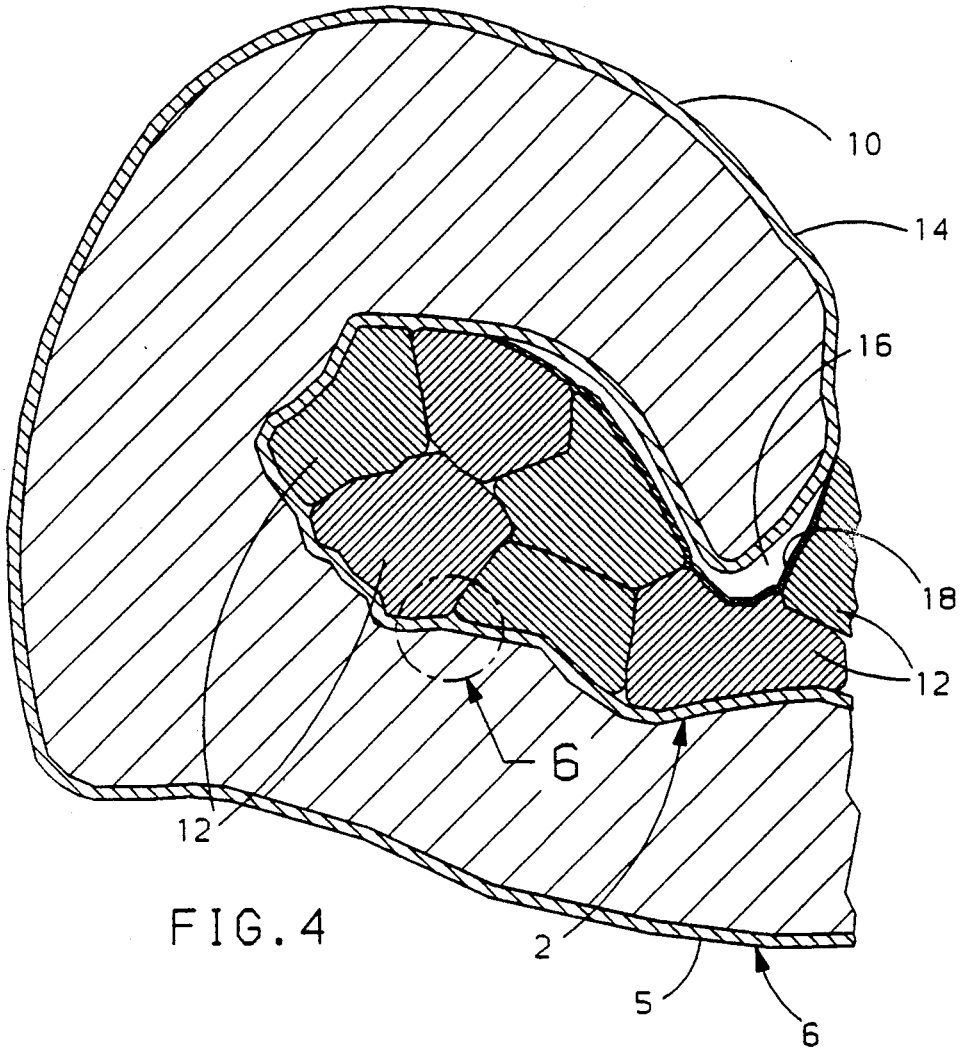
FIG. 4 is an enlargement of a portion of FIG. 3, but after the connection has been subjected to the process of the present invention.
Figure 5:
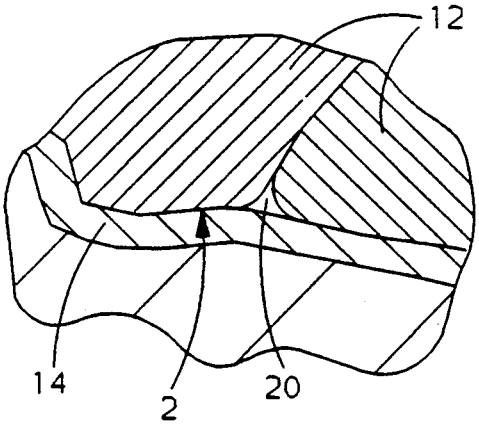
FIG. 5 is a magnified view of FIG. 3 similar to FIG. 6 showing the interface between the wire and the terminal.
Figure 6:
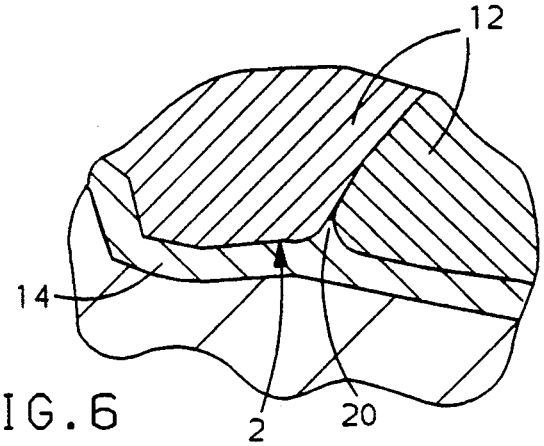
FIG. 6 is a magnified view of the interface between the wire and the terminal where indicated on FIG. 4.

The present invention reduces the deleterious affects of the air gaps 16 caused by spring back of the wings 10 and separation of the wires themselves. In accordance with the present invention, the joint between the terminal 6 and the wire 2 is contacted with an electrolyte so that when the terminal is crimped onto the wire, the more anodic metal electrolytically migrates from its source (i.e., on the terminal 6) and plates out as a film on the cathodic metal (i.e., the wires 12). The electrodeposit 18 (see FIG. 4) electrically bridges the gap 16 and protects the cathodic metal from oxidation as well as significantly reduces the deleterious affects of any contamination that subsequently finds its way into the air gaps 16. Moreover, the film penetrates somewhat into the interstices 20 between the wires in the bundle wherever the electrolyte has wetted the wire bundle and the resulting voltage is sufficient to cause plating.

In order to insure the most effective and extensive electrodeposition, it is desirable to use an electrolyte which readily wets the wire bundle. Preferably, the end of the wire bundle 2 is dipped into a solution of the electrolyte prior to attaching the terminal and so as to completely wet the wires. Virtually any electrolyte may be used to form the electrodeposit of the present invention. It is preferred, however, that the electrolyte have a neutral, or near neutral pH, in order to minimize any undesirable corrosion of the terminal/wire. Electrolytes which have been used with varying degrees of success in terms of resistance and corrosion are listed in Table I. Tin salts in the electrolyte are useful to accelerate the process. Particularly preferred electrolytes comprise chlorinated paraffin oils containing sodium petroleum sulfonate, such as is sold commercially by Man-Gill Chemical Company under the trade name Magnu Draw 30 Oil (chlorinated). These electrolytes are particularly useful because they are readily available, inexpensive, readily wet the wire bundle, have an essentially neutral pH and yet are sufficiently ionically conductive to effectively deplate the tin from the terminal onto the wire bundle.

TABLE I

| ELECTROLYTE | CONDUCTIVITY | CORROSION |
|---|---|---|
| Telchem 440 Flux (<3% HCl aq., pH 1.0) | Very Good | Poor |
| Electroless Ni Plating ($NiCl_2.H_2O$, pH 4.4) | Good | Fair |
| 0.14% by Vol. Hand Soap in $H_2O$ (pH 7.7) | Fair | Fair |
| Dow 550 Silicone Oil | Poor | Fair |
| Conducto - Lube (Ag Powder Suspension) | Poor | Fair |

TABLE I-continued

| ELECTROLYTE | CONDUCTIVITY | CORROSION |
|---|---|---|
| Telchem 440 + Nye 813 Silicone Grease | Good | Fair |
| GE Silicone Caulking | Poor | Good |
| Coca Cola Classic (pH 2.5) | Good | Fair |
| Orange Juice (pH 3.8) | Good | Fair |
| Phosphoric Acid (pH 1.5) | Good | Fair |
| 1% Tartaric Acid + $SnCl_2$ | Good | Good |
| 1% Tartaric Acid | Fair | Good |
| Alpha 740 Soldering Flux (pH 2.0) | Fair | Fair |
| 1% Sodium Citrate + 1% HCl (pH 1.2) | Very Good | Fair |
| 1% Sodium Citrate (pH 8.0) | Fair | Poor |
| 1% $SnCl_2$ (pH 2.0) | Fair | Good |
| 0.5% HCl + 1% $SnCl_2$ (pH 1.3) | Good | Fair |
| 3% HCl (pH 8.0) | Very Good | Poor |
| 0.5% HCl (pH 1.4) | Good | Good |
| Locktite Cleaner & Sealer | Good | Good |
| 33% by Vol. Telchem + $H_2O$ | Very Good | Very Good |
| Magnu Draw 30 Oil | Very Good | Very Good |
| Salt Water (Saturated) | Very Good | Poor |
| Hand Soap (pink) | Very Good | Poor |
| Stabilant 22A Contact Enhancer (Oil) | Fair | Good |
| Plant $H_2O$ | Fair | Very Good |
| Acid Tin Plating Solution | Very Good | Poor |
| Caustic Cleaner | Very Good | Poor |
| Dag 154 Graphite Coating (Acheson Colloids) | Fair | Good |
| Acetic Acid (pH 1.0) | Good | Good |
| Acetic Acid (pH 2.5) | Fair | Good |

EXAMPLES

A number of identical terminals were crimped to a number of identical bundles of wires. More specifically, tin-coated, bronze terminals (i.e., 280 Series Metri-Pack—male) were crimped onto 18 AWG 16 Strand copper wire. One of the assemblies (Sample A) was crimped without contacting the wire with an electrolyte. Samples B, C, D and E were assembled after the wire bundle had been dipped in four different electrolytes. Table II shows the comparison of the change in electrical resistance observed in the samples after they had been subjected to an accelerated environmental sequence wherein they underwent:

1. 72 cycles of 30 minutes at −40° C. and 30 minutes at +125° C.; and
2. 4 cycles of 16 hours at 95–98% relative humidity at 65° C., 2 hours at −40° C., 2 hours at +85° C. and 4 hours at +25° C.

TABLE II

| ELECTROLYTE | MAX. RESISTANCE CHANGE AFTER ACC. ENV. SEQUENCE (mohm) |
|---|---|
| Sample A (Control) No Electrolyte Added | 0.89 |
| Sample B (Telchem 440) Chlorinated Soldering Flux | 0.08 |
| Sample C (Magnu-Draw 30) Chlorinated Oil | 0.14 |
| Sample D (Salt Water) | 0.12 |
| Sample E (Hand Soap) | 0.11 |

While the invention has been disclosed primarily in terms of specific embodiments thereof it is not intended to be limited thereto, but rather only to the extent set forth hereafter in the claims which follow.

What is claimed is:

1. A method of manufacturing a low resistance electrical connection between a wire and a terminal comprising the steps of crimping said terminal onto said wire so as to form a mechanical joint therebetween, said terminal and wire each being comprised of different metals wherein one of said metals is more anodic than the other of said metals in the presence of an electrolyte, and contacting said joint with sufficient electrolyte to electrodeposit said one metal onto said other metal and bridge any gaps that exist between said terminal and said wire before said wire and terminal are put into service.

2. The method according to claim 1 wherein said terminal is coated with said one metal.

3. The method according to claim 2 wherein said one metal is tin and said other metal is copper.

4. The method according to claim 3 wherein said electrolyte comprises a chlorinated stamping oil.

5. The method according to claim 2 wherein said electrolyte comprises soldering flux.

6. The method according to claim 1 wherein said terminal and/or said wire are contacted by said electrolyte before crimping.

* * * * *